US005205659A

United States Patent [19]

Gugel et al.

[11] Patent Number: 5,205,659

[45] Date of Patent: Apr. 27, 1993

[54] PRINT HEAD WITH LUBRICATOR

[75] Inventors: Bernd Gugel, Ulm-Einsinger; Johann Stempfle, Pfaffenhofen, both of Fed. Rep. of Germany

[73] Assignee: Mannesmann Aktlengesellschaft, Fed. Rep. of Germany

[21] Appl. No.: 550,547

[22] Filed: Jul. 10, 1990

Related U.S. Application Data

[63] Continuation-in-part of Ser. No. 387,343, Jul. 28, 1989, Pat. No. 5,000,593.

[30] Foreign Application Priority Data

Aug. 31, 1988 [EP] European Pat. Off. ..... 88 730 194.3
Jul. 10, 1989 [DE] Fed. Rep. of Germany ..... 3922993

[51] Int. Cl.[5] ..... B41J 2/28
[52] U.S. Cl. ..... 400/124; 101/93.05
[58] Field of Search ..... 400/124, 157.2; 101/93.05, 93.29

[56] References Cited

U.S. PATENT DOCUMENTS 4,208,138 6/1980 Volke et al. ..... 400/124
4,756,246 7/1988 Kotasek et al. ..... 400/157.2
4,812,061 3/1989 Tsuyuki ..... 400/124
4,840,501 6/1989 Wong et al. ..... 400/124

FOREIGN PATENT DOCUMENTS 181877 11/1982 Japan ..... 400/124
124260 7/1985 Japan ..... 400/124
171359 8/1986 Japan ..... 400/124

*Primary Examiner*—Edgar S. Burr
*Assistant Examiner*—Stephen R. Funk

[57] ABSTRACT

A matrix print head comprises several armature device groups which, in each case, comprise a magnet yoke (9) with an electromagnetic coil (10), disposed on one of the magnet yoke arms (9*a*), and an armature (8), which armature serves as a drive for a print element (2). The armature (8) can be moved in a rapid sequence against the pole faces (20*b*) of the magnet yokes (9) and back into a rest position. In order to reduce the wear at the pole faces (20*a* and 20*b*) or, respectively, at the wear faces (18), high temperature-stable lubricants can be disposed and intercalated in capillary hollow spaces (17) of armatures (8) and/or magnet yokes (9). These capillary hollow spaces (17) are adjoining and running to the wear faces (18).

20 Claims, 2 Drawing Sheets

17
19
19
19
19
8
14
13
3
2
1
9
8
15
16
9a
10
4
11
6
12
5
7

PRINT HEAD WITH LUBRICATOR

CROSS-REFERENCE TO RELATED APPLICATIONS

This application is a continuation-in-part application of another application filed Jul. 28, 1989 and bearing Ser. No. 07/387,343, now U.S. Pat. No. 5,000,593. The entire disclosure of this latter application, including the drawings thereof, is hereby incorporated in this application as if fully set forth herein.

BACKGROUND OF THE INVENTION

1. Field of the Invention

The invention relates to a matrix print head with several armature device groups, where each armature device group comprises a magnet yoke with an electromagnetic coil, disposed on one of the arms of the magnet yoke, and an armature, where the armature serves as a drive for a print element, and wherein the armature can be positioned in a fast sequence against the pole surfaces of the magnet yoke and back into a rest position.

2. Brief Description of the Background of the Invention Including Prior Art

The actuation of such matrix print heads results in a wear at the pole faces and at the bearing positions of the armature. The lifetime of the matrix print heads is consequently limited based on this wear.

It has been attempted in the past to decrease the wear at the pole faces by employing a plastic foil. The plastic foil, however, generates an additional air gap, which decreases the efficiency of the magnet system.

A lubricating device for the print wires in dot matrix print heads is known from the German Utility Model DE-Gbm 73 00 743. This reference teaches to furnish one of the halves of the casing with a recess into which an oil-impregnated felt is inserted. The print wires are furnished with oil and thus the friction is decreased.

SUMMARY OF THE INVENTION

1. Purposes of the Invention

It is an object of the present invention to decrease the wear at the contact positions, or, respectively, the impact surfaces between the armature and the pole face.

It is another object of the present invention to provide a magnet yoke armature construction which increases the lifetime expectancy of magnetic print heads.

These and other objects and advantages of the present invention will become evident from the description which follows.

2. Brief Description of the Invention

According to the present invention, a matrix print head comprises a plurality of armature device groups. Each armature device group in each case comprises the following:

A magnet yoke having a first arm and having a second arm and each arm having a pole wear face and forming a first magnetic circuit element.

An electromagnetic coil disposed on the first arm of the magnet yoke.

An armature mechanically connected to a print pin element and forming a second magnetic circuit element and having a wear face for contacting the pole wear face during operation and serving as a driver for the print element. The armature can be moved and positioned in a rapid sequence against the pole faces of the magnet yoke and back into a rest position depending on actuating currents passing through the electromagnetic coil.

Capillary hollow spaces disposed in one of the magnetic circuit elements. These capillary hollow spaces are leading to and are adjoining a wear face.

A temperature-stable lubricant deposited into the capillary hollow spaces.

The pole faces of the arms of the magnet yoke can be substantially disposed in a common plane.

The temperature-stable lubricant can be intercalated into one of the magnetic circuit elements prior to assembly of the matrix print head. The lubricant can exhibit a thermal stability of up to about a temperature of at least about 400° C. The lubricant can be a member selected from the group consisting of temperature-stable oils, molybdenum disulfide, and mixtures thereof.

The capillary hollow spaces in the magnetic circuit element can be formed by superpositioned lamellas, which are fixedly attached to each other. The capillary hollow spaces can be furnished by residual pores remaining in a sintered magnet material.

A method for the production of matrix print heads including magnetic circuit elements for matrix print heads, comprises the following steps. A temperature-stable lubricant is heated to an elevated temperature. A magnet circuit element for a matrix print head is immersed, prior to assembly, into the heated temperature-stable lubricant under elevated pressure for an extended period of time. The magnetic circuit element is cooled to ambient temperature. The magnetic circuit element is assembled into a matrix print head. The magnetic circuit element can be an armature or a magnet yoke.

Temperature stable lubricants are deposited in capillary hollow spaces of an armature and/or a magnet yoke. These capillary hollow spaces are adjoining at the wearing faces. Advantageously, based on this construction, the wear between the armature and the pole face can be reduced to a substantial degree.

The furnishing of a supply of lubricants results in a higher lifetime expectancy of the device. It is particularly advantageous to employ a lubricant transport and feeding brought about by a quick impact sequence. Consequently, a permanent lubricating film is generated at the faces contacting each other.

According to a further aspect of the invention, the temperature-stable lubricants can be stored and intercalated already at the time of production of the soft magnetic armature and/or of the soft magnet yoke.

Advantageously, the lubricants are selected from temperature-stable lubrication materials which have a temperature stability of, for example, about and/or above 400° C., such as, for example, oils, molybdenum disulfides, and the like.

The intercalation and feeding of such lubricants can be performed according to the invention in that capillary hollow spaces are formed by superpositioned lamellas. The intercalation is thus performed during the normal production of the components.

According to a further aspect of the invention, the capillary hollow spaces are produced by way of sintered materials.

In addition, a method for the production of armatures and/or magnet yokes for matrix print heads is particularly advantageous where, before mounting, the armatures or, respectively, the magnet yokes are immersed into the temperature-stable lubricants, after the lubricants have been heated, while being subjected to elevated pressure for an extended period of time.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figures 1, 2:
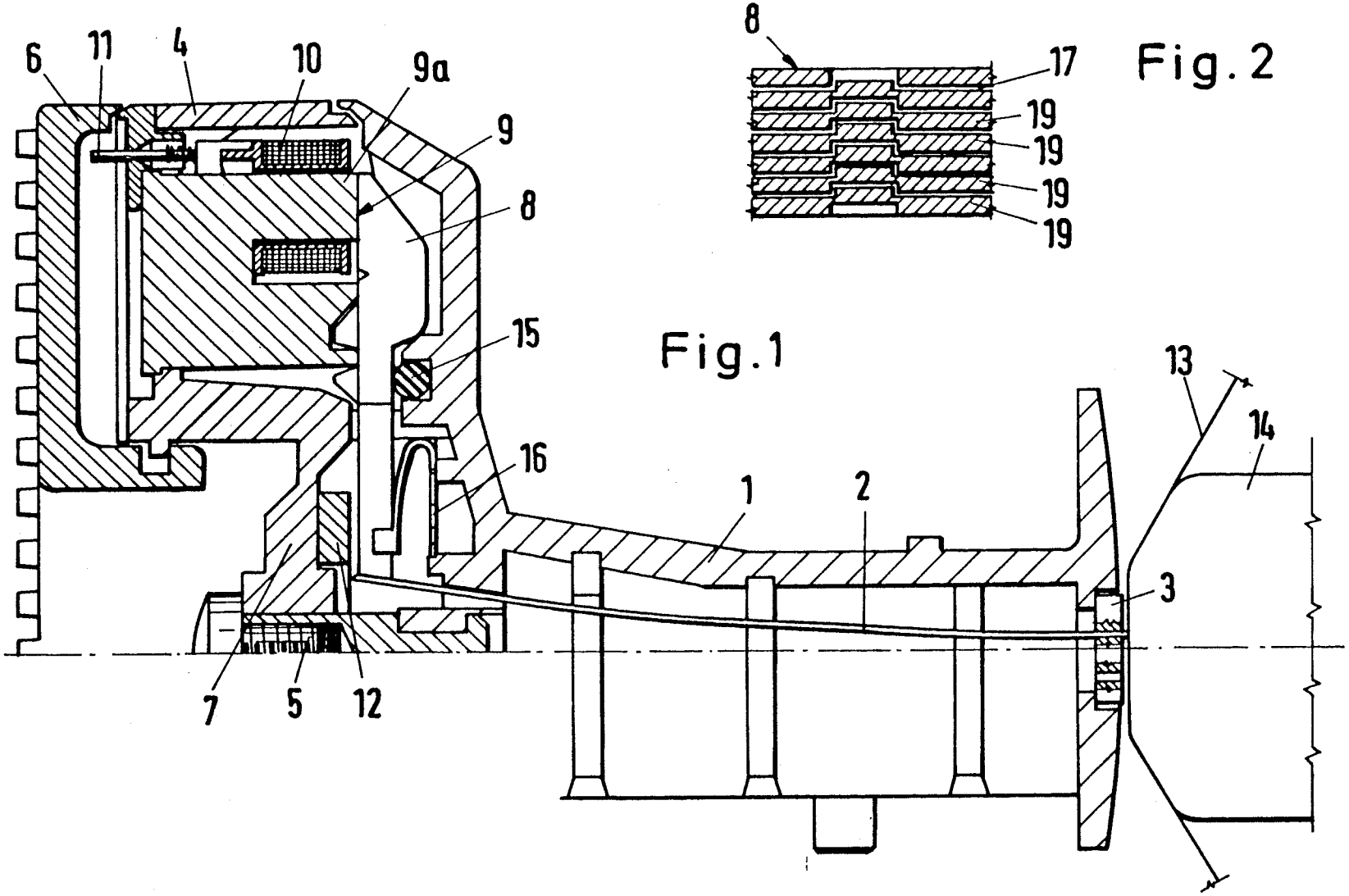
FIG. 1 is a longitudinal sectional view of a matrix print head with armature and magnet yokes.
FIG. 2 is a partial cross-sectional view through an armature of a magnetic print head.

According to the present invention, there is provided a matrix print head with several armature device groups. These armature device groups in each case comprise a magnet yoke with an electromagnetic coil, disposed on one of the magnet yoke arms, and an armature. Said armature serves as a drive for a print element. The armature can be moved and positioned in a rapid sequence against the pole faces of the magnet yoke and back into a rest position. Temperature-stable lubricants can be deposited into capillary hollow spaces 17 of the armature 8 and/or of the magnet yoke 9. These capillary hollow spaces 17 are leading to and are adjoining wear faces 18.

The temperature-stable lubricants can already be intercalated into the armature 8 and/or the magnet yoke 9 during their production process. The lubricant can comprise materials with a thermal stability of up to about 400° C. The lubricant can be a member selected from the group consisting of temperature-stable oils, molybdenum disulfide, and mixtures thereof.

The capillary hollow spaces 17 can be formed by superpositioned lamellas 19 fixedly attached to each other. The capillary hollow spaces 17 can be furnished by employing sintered magnet materials.

A method for the production of armatures and/or magnet yokes for matrix print heads comprises the following steps. The armature 8 or, respectively, the magnet yokes 9 are immersed before assembly into a temperature-stable lubricant, after heating of the lubricant, and under elevated pressure for an extended period of time.

The matrix print head, according to FIG. 1, includes a pin guide casing 1 with print pins 2 in a number amounting to 9, 14, 18, 24 or more, as well as a guide mouth piece 3. The print elements 2, represented by print pins, form several slots in the guide mouth piece 3, and are guided by way of pin guides, furnished, for example, by rubies, by ceramic materials, by plastics, and the like. An electromagnetic coil casing 4 is supported and fixedly mounted at a precise distance at the pin guide casing 1 by way of a centered screw 5 and is closed by way of a cover 6. An electromagnetic coil support 7, receiving all armature device groups corresponding to the number of print elements 2, is disposed within the electromagnetic coil casing 4. Corresponding to the number of print elements 2 with armatures 8, there is provided in each case a respective magnet yoke body of the magnet yoke 9 on the electromagnetic coil support 7. In each case, an electromagnetic coil 10 with a cable connection 11 is disposed at the radially outer magnet yoke arm 9*a* of the magnet yoke body. The armatures 8 are retained in two positions. One position represents the rest position at a detent ring 12, furnishing a rearward rest position. The second position represents the impact position, where a print element 2 produces, via an ink ribbon (not illustrated here), a color dot on a recording material carrier 13. The recording material carrier 13 is resting on a print counter support 14.

The print element 2 is attached at each armature 8 either, in the way illustrated, by immediate attachment by, for example, welding, or alternatively, the print element 2 rests with a pin head at the front face of the armature 8 based on a spring force. The armature 8, furthermore, rests against a support ring 15. This support ring 15 acts simultaneously as a damping element operating in the range of the actuating frequency of the matrix pin print head (up to 4000 Hz). Furthermore, each armature is retained, by way of a special arm spring 16, under pretensioning in the backward position. The front position of the print elements 2 is illustrated in FIG. 1.

Figure 4:
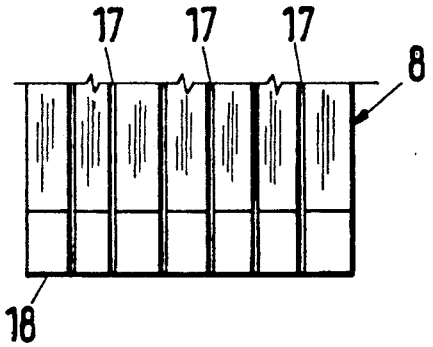
FIG. 4 is a partial front elevational view of the armature, at an enlarged scale.
Figure 5:
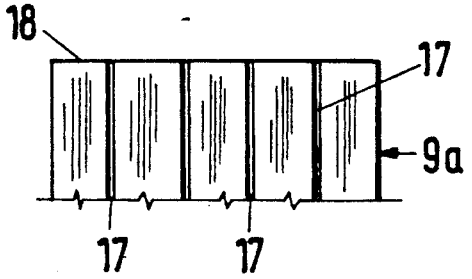
FIG. 5 is a partial side elevational view of a magnet yoke arm after removal of the electromagnetic coil, again at an enlarged scale.

The temperature-resistant lubricants are disposed in capillary hollow spaces 17 of the armature 8 and/or in the magnet yoke 9 as can be recognized from FIG. 2. These capillary hollow spaces 17 are leading to and adjoining at the wearing faces 18, as illustrated in FIGS. 4 and 5.

The temperature-resistant and temperature-stable lubricants can, however, already be intercalated during the production of the armature or, respectively, of the magnet yoke 9 by way of different processes. Up to about 400° C. temperature-stable oils, molybdenum disulfide, and the like, can be furnished as lubricants. Other lubricants suitable include graphite, lead monoxide, basic lead bicarbonate, lead glasses, glasses, minium, red lead oxide, surface layers of oxide or sulfide, or polytetrafluorethylene.

The capillary hollow spaces 17 can be produced in an easy production way by lamellas 19, which are superposed on top of each other, as illustrated in FIGS. 2 or, respectively, 4 and 5. The superpositioning alone of the punched lamellas 19, furnished with the lubricant, generates the desired capillary hollow spaces 17, as illustrated in FIG. 2. The capillary hollow spaces 17 can have a dimension of from about 0.01 to 0.02 relative to the corresponding dimension of the lamella 19, and preferably have a dimension of from 0.05 to 0.1 relative to the corresponding dimension of the lamella 19. However, the soft-magnetic armature 8 and the soft magnet yoke 9 can also and/or alternatively be produced from sintered materials. The sintered materials are generally from composition powders resulting in soft magnetic structures having a high magnetic permeability and a low magnetic coercitivity, where pores remain between the sintered powder for transport and feeding of the lubricant to the surface. The lubricant should be selected such as to provide a suitable tendency to move to the surface. In this case as well, the corresponding lubricant can be intercalated and deposited already during the production into the capillary hollow spaces 17 present after the sintering process.

In this case, only one lamella 19*a* has to extend completely from the armature 8 to the print element 2. The remaining lamellas 19 are formed such as to substantially cover only the pole faces 20*a* or, respectively, 20*b* and the remaining lamellas 19 are joined to a package by way of rivets 21.

It is further possible to operate a method for the production of the armature 8 and/or of the magnet yokes 9 for matrix print heads in such a way that the armatures 8 or, respectively, the magnet yokes 9 are immersed for an extended period of time into the temperature-stable lubricants after the heating of the temperature-stable lubricants and under increased pressure. Preferably, prior to the immersion of the armatures 8 and/or of the magnet yokes 9 into the lubricant, the armatures 8 and/or the magnet yokes 9 are placed into a vacuum and their hollow spaces evacuated, thereby generating a suction effect into the hollow spaces during the immersion into the lubricant depending on the pressure prevailing in the lubricant. After a cooling to operating temperature, the desired lubricant supplies are already present in the capillary hollow spaces 17 of the materials of the armature 8 and/or the magnet yoke 9.

Preferably, the magnet yoke 9 and the armature 8 are formed from a number of lamella layers of from about 3 to 20, and preferably from about 5 to 12 lamella layers. The lamellas of the armatures 8 are preferably positioned such that, upon impact, they do not coincide exactly one to one and align with the lamellas of the magnet yoke 9, but instead they meet respectively a hollow space on the opposing side and the hollow spaces between the lamellas of the armature 8 and of the magnet yoke 9 are staggered relative to each other. The size of the hollow spaces between the lamellas can be adjusted and set in the course of the rivetting of said lamellas to a package with the rivets 21.

Figure 3:
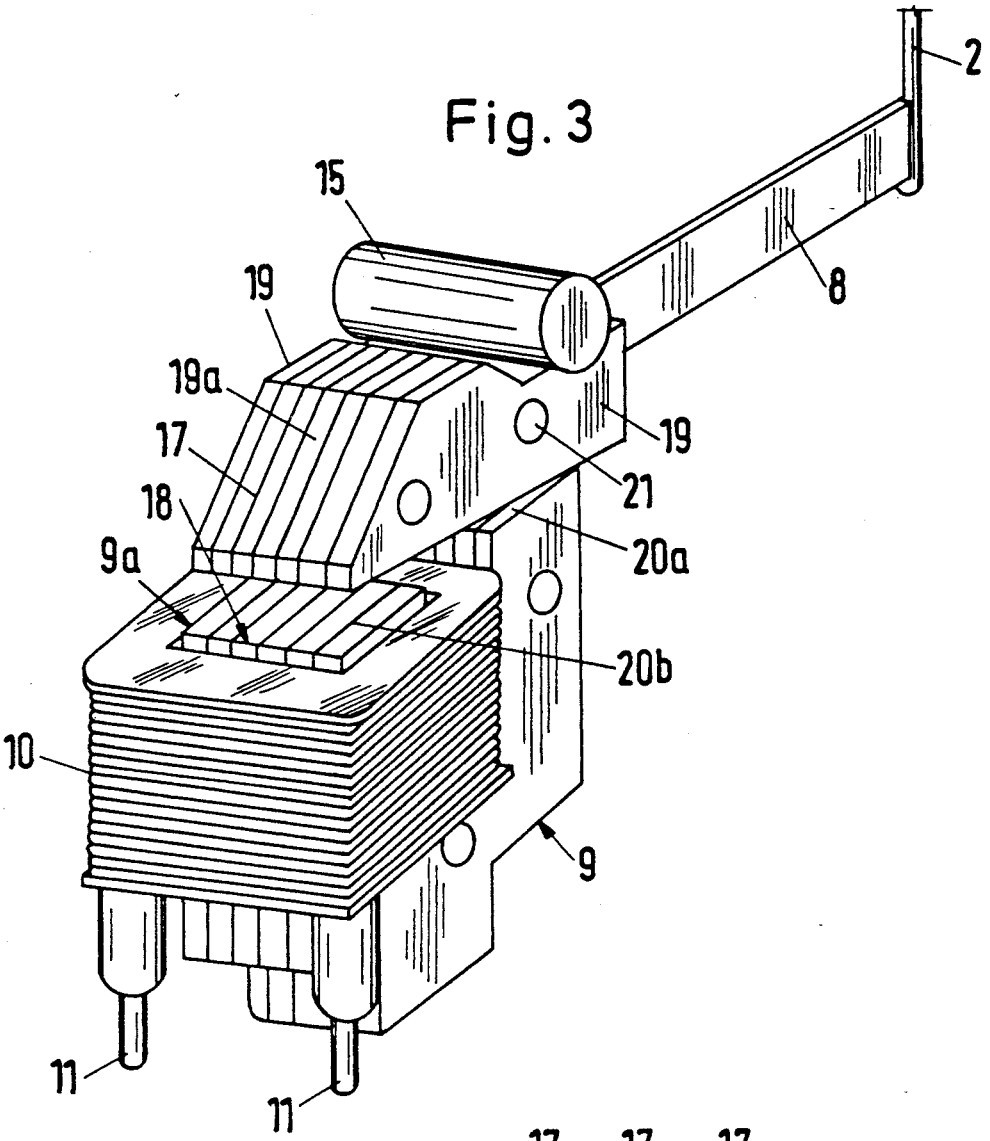
FIG. 3 is a perspective partial view of a magnet yoke, of an electromagnetic coil, and of an armature with an armature support structure.

Preferably, the planes of the hollow spaces between the lamellas of the armatures 8 and the planes of the hollow spaces between the magnet yoke 9 are disposed in parallel planes, which are oriented perpendicular to the hinge axis of the armature 8. A single lamella of the armature 8 can be employed for connecting the armature 8 to the print element 2 (FIG. 3). The structure of the lamellae package of the armature is such that an effective magnetic flux connection results between the magnet yoke arms and the armature 8. Thus, the thickness of the lamellae package for the armature 8 is equal to about 0.9 to 1.1 times the thickness of the lamellae package of the magnet yoke 9. Preferably, the thickness of the lamellae package of the armature 8 and of the magnet yoke 9 are substantially equal.

It will be understood that each of the elements described above, or two or more together, may also find a useful application in other types of print heads differing from the types described above.

While the invention has been illustrated and described as embodied in the context of a matrix print head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A matrix print head comprising a plurality of armature device groups, with each armature device group comprising a magnet yoke formed of lamellas with capillary hollow spaces disposed between the lamellas and wherein the capillary spaces are formed by superposition of the lamellas and wherein the lamellas are fixedly attached to each other, said magnet yoke having a first arm and having a second arm and each arm having a pole wear face, wherein the capillary hollow spaces are leading to and adjoining the pole wear faces of the magnet yoke and forming a first magnetic circuit element to be attached to a print head casing;

an electromagnetic coil disposed on the first arm of the magnet yoke;

a print pin element;

an armature mechanically connected to the print pin element and forming a second magnetic circuit element and having an armature wear face for contacting a respective one of the pole wear faces during operation and serving as a driver for the print element, where the armature is movable and positionable in a rapid sequence against the pole wear faces of the respective magnet yoke and back into a rest position depending on actuating currents passing through the electromagnetic coil; a temperature-stable lubricant deposited into the capillary hollow spaces.

2. The matrix print head according to claim 1, wherein the pole wear faces of the arms of the magnet yoke are substantially disposed in a common plane.

3. The matrix print head according to claim 1, wherein the temperature-stable lubricant is intercalated into the first magnetic circuit elements prior to assembly of the matrix print head.

4. The matrix print head according to claim 1, wherein the temperature-stable lubricant exhibits a thermal stability up to about a temperature of at least about 400° C.

5. The matrix print head according claim 1, wherein the temperature-stable lubricant exhibits a thermal stability up to about a temperature of at least about 400 degrees C. and wherein the lubricant is a temperature-stable oil.

6. The matrix print head according to claim 1, wherein the temperature-stable lubricant exhibits a thermal stability up to about a temperature of at least about 400° C., and wherein the lubricant is a molybdenum disulfide.

7. A matrix print head with several armature device groups, which armature device groups comprise a magnet yoke formed of a plurality of superposed lamellas with capillary hollow spaces formed between the superposed lamellas, wherein the lamellas are fixedly attached to each other, and wherein said magnet yoke is to be attached to a print head casing and having two magnet yoke arms and furnished with an electromagnetic coil disposed on one of the magnet yoke arms, and an armature, which armature serves as a drive for a print element, where the armature is movable and positioned in a rapid sequence against pole wear faces of the magnet yoke and back into a rest position, wherein temperature-stable lubricants are deposited into the capillary hollow spaces (17) of the magnet yoke (9), and wherein these capillary hollow spaces (17) are leading to and are adjoining the pole wear faces (18).

8. The matrix print head according to claim 7, wherein the temperature-stable lubricants are already intercalated into the magnet yoke (9) during its production process.

9. The matrix print head according to claim 7, wherein the temperature-stable lubricants comprise materials with a thermal stability of up to about 400° C.

10. The matrix print head according to claim 9, wherein the temperature-stable lubricants comprise a material with a thermal stability of up to about 400° C. and wherein the lubricant is a molybdenum disulfide.

11. The matrix print head according to claim 7, wherein the temperature-stable lubricants comprise a material with a thermal stability of up to about 400 degrees C. and wherein the lubricant is a temperature-stable oil.

12. A matrix print head with several armature device groups, which armature device groups comprise a magnet yoke having two magnet yoke arms and furnished with an electromagnetic coil disposed on one of the magnet yoke arms, and an armature, wherein the armature is formed of lamellas with capillary hollow spaces disposed between the lamellas, and wherein the capillary hollow spaces are formed by superposition of the lamellas, and wherein the lamellas are fixedly attached to each other, said armature serving as a drive for a print element, where the armature is movable and positioned in a rapid sequence against pole wear faces of the magnet yoke and back into a rest position, wherein the armature contains temperature-stable lubricants deposited into the capillary hollow spaces (17) of the armature (8), and wherein these capillary hollow spaces (17) are leading to wear faces (18) of the armature (8).

13. The matrix print head according to claim 12, wherein the temperature-stable lubricants are already intercalated into the armature (8) during its production process.

14. The matrix print head according to claim 12, wherein the temperature-stable lubricants comprise a material with a thermal stability of up to about 400° C.

15. The matrix print head according to claim 14, wherein the temperature-stable lubricants comprise a member selected from the group consisting of temperature-stable oils, molybdenum disulfide, and mixtures thereof.

16. A matrix print head comprising a plurality of armature device groups, with each armature device group comprising a magnet yoke having a first arm and having a second arm and each arm having a pole wear face and forming a first magnetic circuit element attached to a print head casing;

an electromagnetic coil disposed on the first arm of the magnet yoke;

a print pin element;

an armature formed of lamellas with capillary hollow spaces disposed between the lamellas and wherein the lamellas are fixedly attached to each other, said armature being mechanically connected to the print pin element and forming a second magnetic circuit element and having an armature wear face for contacting a respective one of the pole wear faces during operation, wherein said capillary hollow spaces are leading to and adjoining the armature wear face and said armature is serving as a driver for the print element, where the armature is movable and positionable in a rapid sequence against the respective one of the pole wear faces of the respective magnet yoke and back into a rest position depending on actuating currents passing through the electromagnetic coil;

a temperature-stable lubricant pressed at elevated temperature and pressure into the capillary hollow spaces.

17. The matrix print head according to claim 16, wherein the pole wear faces of the arms of the magnet yoke are substantially disposed in a common plane.

18. The matrix print head according to claim 16, wherein the lubricant exhibits a thermal stability up to about a temperature of at least about 400 degrees C. and wherein the lubricant is a temperature-stable oil.

19. The matrix print head according to claim 16, wherein the temperature-stable lubricant is intercalated into the armature prior to assembly of the matrix print head.

20. The matrix print head according to claim 16, wherein the lubricant is a member selected from the group consisting of temperature-stable oils, molybdenum disulfide, and mixtures thereof.

* * * * *